US009815601B2

(12) United States Patent
Browne

(10) Patent No.: US 9,815,601 B2
(45) Date of Patent: Nov. 14, 2017

(54) PACKAGE

(71) Applicant: GE HEALTHCARE AS, Oslo (NO)

(72) Inventor: Martin Monteagle Browne, Oslo (NO)

(73) Assignee: GE HEALTHCARE AS, Oslo (NO)

( * ) Notice: Subject to any disclaimer, the term of this patent is extended or adjusted under 35 U.S.C. 154(b) by 0 days.

(21) Appl. No.: 14/345,696

(22) PCT Filed: Sep. 28, 2012

(86) PCT No.: PCT/EP2012/069195

§ 371 (c)(1),
(2) Date: Mar. 19, 2014

(87) PCT Pub. No.: WO2013/045619

PCT Pub. Date: Apr. 4, 2013

(65) Prior Publication Data

US 2014/0217099 A1 Aug. 7, 2014

(30) Foreign Application Priority Data

Sep. 29, 2011 (EP) ..... 11183296

(51) Int. Cl.

| | |
|---|---|
| ***B65D 51/18*** | (2006.01) |
| ***A61J 1/14*** | (2006.01) |
| ***B65D 51/00*** | (2006.01) |

(52) U.S. Cl.

CPC ..... *B65D 51/18* (2013.01); *A61J 1/1406* (2013.01); *A61J 1/1412* (2013.01); *B65D 51/002* (2013.01); *B65D 2101/0023* (2013.01)

(58) Field of Classification Search

CPC ..... A61J 1/1406; A61J 1/1412; B65D 51/18; B65D 51/002; B65D 2101/0023

USPC ..... 215/247, 249; 604/415

See application file for complete search history.

(56) References Cited

U.S. PATENT DOCUMENTS

| | | | | |
|---|---|---|---|---|
| 4,231,486 | A | 11/1980 | Bock | |
| 4,366,912 | A | 1/1983 | Matukura et al. | |
| 5,718,348 | A | 2/1998 | Manera | |
| 5,902,298 | A | 5/1999 | Niedospial, Jr. et al. | |
| 6,223,918 | B1 | 5/2001 | Browne | |
| 6,692,478 | B1 | 2/2004 | Paradis | |
| 6,868,978 | B2 | 3/2005 | Amschlinger et al. | |
| 2003/0029828 | A1 * | 2/2003 | Amschlinger et al. | 215/247 |
| 2009/0166311 | A1 | 7/2009 | Claessens | |
| 2014/0217099 | A1 | 8/2014 | Browne | |
| 2014/0299568 | A1 | 10/2014 | Browne | |

FOREIGN PATENT DOCUMENTS

| | | |
|---|---|---|
| CN | 1083011 A | 3/1994 |
| CN | 1155265 A | 7/1997 |
| CN | 1250365 A | 4/2000 |

(Continued)

OTHER PUBLICATIONS

English translation of DE 35 19 655 obtained from espacenet website at EPO. Sep. 2014.*

(Continued)

*Primary Examiner* — James N Smalley

(57) ABSTRACT

The present invention relates to a package, and more particularly to a package for sterile fluids, such as contrast media. More particularly the invention relates to a package comprising a container, a stopper (40), a cap (50) and a flip cover (60).

10 Claims, 5 Drawing Sheets

(56) References Cited

FOREIGN PATENT DOCUMENTS

| | | | | |
|---|---|---|---|---|
| CN | 1431967 | A | | 7/2003 |
| CN | 103826985 | A | | 5/2014 |
| CN | 104105468 | A | | 10/2014 |
| DE | 1228028 | | | 11/1966 |
| DE | 3519655 | A1 | * | 12/1986 |
| DE | 4204427 | C1 | | 7/1993 |
| DE | 4428434 | A1 | | 2/1996 |
| EP | 0291658 | A1 | | 11/1988 |
| EP | 0624527 | A1 | | 11/1994 |
| EP | 0761562 | | | 3/1997 |
| EP | 0960616 | A2 | | 12/1999 |
| EP | 1084063 | A1 | | 3/2001 |
| EP | 1044135 | B1 | | 10/2002 |
| EP | 1707500 | A1 | | 10/2006 |
| EP | 2231488 | A1 | | 9/2010 |
| FR | 2355730 | A1 | | 1/1978 |
| FR | 2625479 | A1 | | 7/1989 |
| JP | 55-108056 | U1 | | 7/1980 |
| JP | 05-003152 | U1 | | 1/1993 |
| JP | 10-095451 | A | | 4/1998 |
| JP | 11321916 | A | | 11/1999 |
| JP | 2003-516277 | A | | 5/2003 |
| JP | 2014532405 | A | | 12/2014 |
| JP | 2015505698 | A | | 2/2015 |
| WO | 9309036 | A1 | | 5/1993 |
| WO | 9322210 | A1 | | 11/1993 |
| WO | 98/30188 | | | 7/1998 |
| WO | 9832411 | A1 | | 7/1998 |
| WO | 9941159 | A1 | | 8/1999 |
| WO | 0003920 | A2 | | 1/2000 |
| WO | 0160699 | A2 | | 8/2001 |
| WO | 2009083458 | A1 | | 7/2009 |
| WO | 2011039004 | | | 4/2011 |
| WO | 2013045619 | A1 | | 3/2013 |
| WO | 2013062416 | A1 | | 5/2013 |
| WO | 2013087817 | A1 | | 6/2013 |

OTHER PUBLICATIONS

PCT/EP2012/069195 ISRWO dated Nov. 28, 2012.
International Search Report and Written Opinion for PCT/EP2012/075491, dated Apr. 4, 2013, 11 pages.
Chinese Office Action for 201280047700.5 dated Feb. 28, 2015 and English Translation of the same, 15 pages.
European Office Action for 12762646.3 dated Apr. 29, 2015, 6 pages.

* cited by examiner

PACKAGE

This application is a filing under 35 U.S.C. 371 of international application number PCT/EP2012/069195, filed Sep. 28, 2012, which claims priority to EP application number 11183296.0 filed September 29, the entire disclosure of which is hereby incorporated by reference.

The present invention relates to a package, and more particularly to a package for sterile fluids, such as contrast media. More particularly the invention relates to a package comprising a container, a stopper, a cap and a flip cover.

In the medical field, sterile fluids, such as medicaments, pharmaceuticals, sterile saline solution and so on are frequently required for the treatment of patients. Such sterile fluids are typically supplied in bottles made of glass, which is chemically inert and highly unlikely to contaminate or otherwise adulterate the sterile fluid, but may also be provided in plastic bottles.

Bottles for sterile fluids are typically closed by a rubber stopper inserted into the mouth of the bottle. The stopper is designed so that it can be pierced by a needle of a hypodermic syringe, an infusion spike of an infusion set, or the like, to allow the contents of the bottle to be withdrawn. The stopper can also be removed to allow the contents of the bottle to be poured out. In order to hold the stopper in place different kinds of over seals exist, such as a cap made of aluminium or similar thin sheet metal being crimped over the stopper and the upper part of the bottle. In order to gain access to the stopper, either to pierce it or remove it, the metal cap is either partially or totally torn away. Aluminium crimps are not an appreciated closure system as tearing the aluminium cap away can cause problems, as sharp edges are left where the cap is torn. These edges are sharp enough to puncture surgical gloves and human skin, which is obviously a disadvantage in the medical field in particular, where the risk of infection must be kept to a minimum.

WO00/03920 of the applicant describes a package on the market comprising a plastic bottle, a stopper and a plastic cap. The cap comprises a cover member which overlies the stopper and which has a region that is removable to expose the upper surface of the stopper. Such a package, although in wide use, has some disadvantages. Polymers that are suitable for use in such packages must withstand autoclaving temperatures typically above 121° C. These polymers are normally very tough to tear. From an end user perspective it is desirable to have an easy to tear polymer. The currently claimed invention resolves this conflict.

For the reasons stated above, and for other reasons stated below, there is a need in the art for an improved package, particularly a closure system, for sterile fluids providing a reduced risk of contamination and with improved user friendliness.

FIG. 1 depicts a cross section view of the closure system 10 of a package of the invention, showing a plastics bottle neck 26, a stopper 40, a cap 50 and a flip cover 60.

FIG. 2 depicts the cap 50 and the flip cover 60 of the closure system 10 of the invention seen from the outside.

FIG. 3 depicts the cap 50 and the flip cover 60 of the closure system 10 of the invention seen from the inside.

Figure 1:
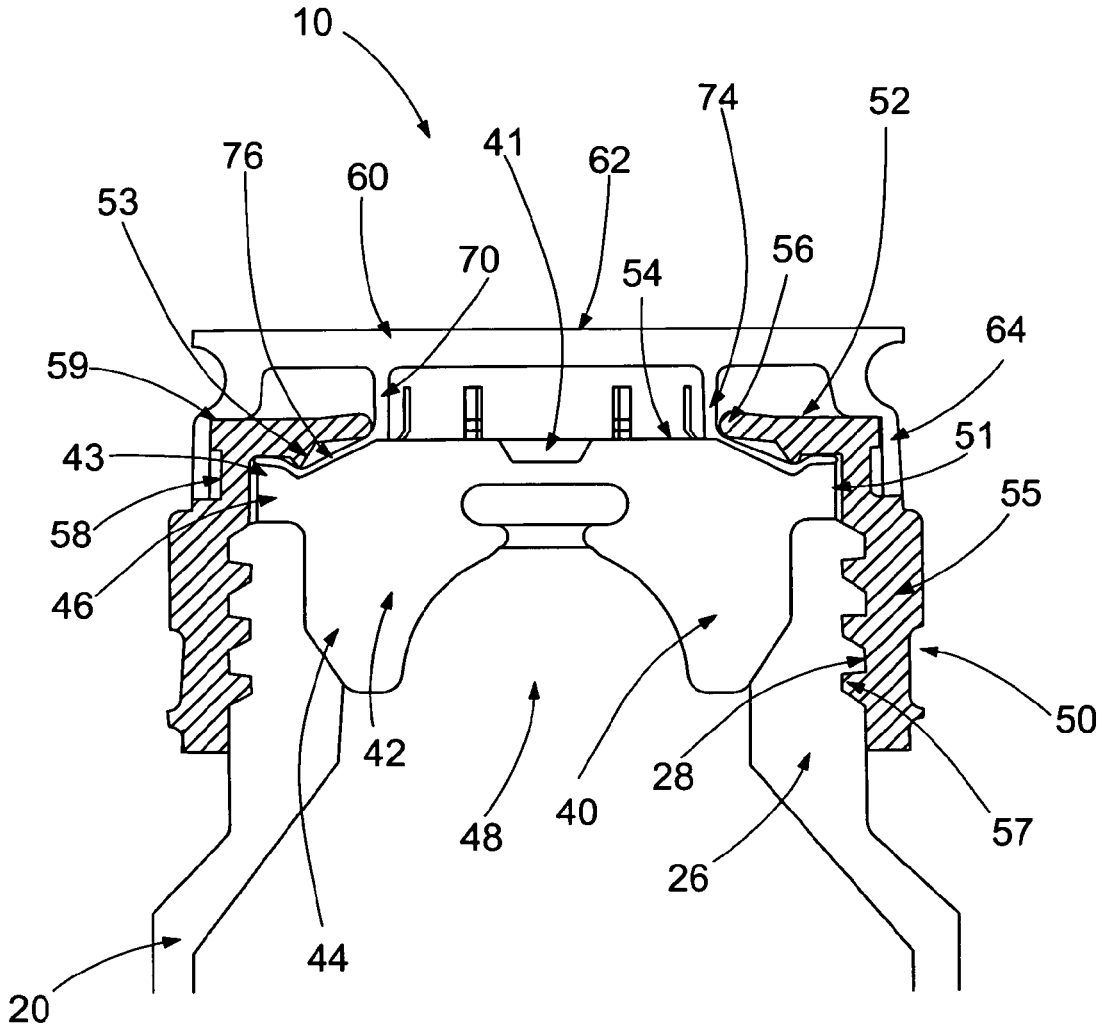

The applicant has now identified a package with improved functionality. The package is easier to open, it includes tamper-evident features to ensure it is not opened and used more than once, and it includes features ensuring the sterile liquid filled in it is kept sterile.

The package is compatible with infusion procedures; open and siphon, open and pour or pierce stopper and extract contents using hypodermic needles or spikes.

Hence, in a first aspect the present invention provides a package comprising a) a container with a mouth, b) a stopper removable inserted into said mouth, c) a cap overlying said stopper wherein said cap comprises a cover aperture defining a centrally-located passageway there through and a cylindrical wall which extends downwardly generally about the periphery of the circular cover aperture, and d) a removable flip cover comprising a generally circular disc overlaying the cover aperture of the cap and said flip cover has a periphery wall being engaged with the cylindrical wall of the cap.

The stopper, cap and the flip cover define a closure system for the container.

The stopper will generally be formed of an elastic material and is preferably also formed from plastics. The stopper may be formed from rubber.

In one preferred embodiment, the container is a bottle. The bottle may be formed of glass or plastic, such as clear or opaque plastic.

Preferably, the container and the cap have complementary screw threads. This provides a simple and effective way of securing the cap on the container. It is further preferred that the cap be provided with a tamper-evident feature, to reduce the risk of fluid being administered from a package which has been opened and then reclosed. Such opening and reclosing can result in the fluid losing its sterility, or in adulteration or contamination of the fluid in some form. One suitable form of tamper-evident feature is a member removably attached to the cap, which must be detached from the cap before the cap can be removed. The absence of the member is then a sign that the package has been opened at some time, and should not be used.

One improvement of the closure system of the package is the inclusion of a removable flip cover overlying the cap, i.e. a flip-top. This removable entity can be removed to gain access to the stopper. With such a closure system, the closure can be opened in a number of ways. The flip cover can be removed to gain access to the stopper, whilst leaving the stopper in place. The stopper can then be pierced by a hypodermic needle or similar, accessible through a cover aperture of the cap. Alternatively, the combined cap with flip cover attached can be removed, which then allows access to the entire stopper. This may be useful if, for example, an infusion spike which is wider than the passage way of the cover aperture of the cap is to be used. As a further alternative, the entire cap and the stopper can be removed, to enable pouring or the insertion of a quill or straw to load an autoinjector. The flip cover can be removed from the cap without tearing or breaking any material, such as a plastic material, in an easy manner, giving access to the stopper. At the same time, the flip cover is adapted to tightly fit the cap reducing the risk of dislocation of the flip cover and ensuring not to contaminate or otherwise adulterate the sterile fluid while the flip cover is in place.

The cap is designed to fit with an overlying flip cover. The cap comprises a circular cover aperture defining a centrally-located passageway there through. The passageway of the cover aperture aligns in overlying registry with the upper surface of the stopper. Hence, the cap has a circular orifice right above the upper surface of the stopper. The cover aperture comprises an inner and an outer perimetrical rim, wherein the inner rim defines the circumference edge of the orifice of the cover aperture. The outer perimetrical rim of the cover aperture defines a cylindrical wall which extends downwardly generally about the periphery of the circular cover aperture. The cap further comprises an annular skirt extending downwardly from the cylindrical wall. The skirt preferably has an internal screw thread formed on its inner surface, which engages with the external screw thread formed on the neck of the bottle to retain the cap in place.

Detachably attached to the lower end of the skirt of the cap there may be a ring functioning as a tamper-evidencing element. The ring engages beneath a lip on the neck of the bottle. In order to remove the cap from the bottle, it is first necessary to detach the ring from the cap, and the detached ring makes it clear to the user that the package has been opened.

The flip cover is a lid for the cover aperture of the cap and is adapted to align in overlying registry with the cover aperture of the cap, and with the stopper. The flip cover comprises a circular disc overlaying the cover aperture of the cap such that the disc engages with the cover aperture. The flip cover further comprises a periphery wall which extends downwardly about the periphery of the circular planar disc, such this can be engaged with the cylindrical wall of the cap. The circumference of the periphery wall of the flip cover is only slightly larger than the circumference of the cylindrical wall of the cover aperture of the cap. In one embodiment, the circular disc is planar. In another embodiment, the circular disc of the flip cover is formed in such manner that it is not planar, for example by having the central part of the disc projecting above the peripheral region. The reasoning for such design is that packages of sterile fluid are frequently autoclaved to ensure sterility, and it is quite possible for steam from the autoclave to condense on the packages during the cooling phase. The drainage of water can be assisted by forming the circular disc member in such a manner that it is not planar.

It is further preferred that the flip cover be provided with a tamper-evident feature, to reduce the risk of fluid being administered from a package which has been opened and then reclosed. Such opening and reclosing can result in the fluid losing its sterility, or in adulteration or contamination of the fluid in some form. One suitable form of a tamper-evident feature of the flip cover is a member that makes it impossible to reattach the flip cover when this has been opened or removed. Hence, in this embodiment the flip cover comprises legs extending downwardly from the circular disc. A leg comprises a first part which is a bar, e.g. an oblong formed bar, extending downwardly from the circular disc. The legs are annularly arranged, preferably regularly spaced. In one embodiment they are positioned perpendicularly to the circular disc, but they may also be attached to the circular disc forming an angel different from 90°. There may be 3 or more legs and preferably 3 to 10. The legs and their position are adapted to fit adjacent to the perimetric inner rim of the cover aperture of the cap. In a preferred embodiment, the periphery wall of the flip cover which extends generally about the periphery of the circular planar disc and the annularly arranged legs are in parallel. In a preferred embodiment, the flip cover includes such legs functioning as a tamper-evident element, making it possible to see if the flip cover has been opened. If the flip cover has been opened, the legs will be broken, bended or deformed and repositioning them under the inner rim of the cover aperture of the cap will not be possible without unscrewing the cap thereby making it possible to see that that the flip cover has been tampered with.

In one embodiment, the ends of the legs, i.e. the ends not being fixed to the circular disc, include slightly bended portions such that the legs better hinge to the perimetric inner rim of the cover aperture of the cap. Hence, the bended portion of the legs extends between the upper surface of the stopper and the underside of the inner perimetric rim of the cap. When such flip cover is positioned on top of the cap, which is overlying the stopper, the legs of the flip cover secure the flip cover to the cap as the legs will be bent around the edge of the orifice of the cap. When removing the flip cover from the cap, the first part of the legs detach from the cover aperture of the cap. When the flip cover has been removed once, it is impossible to reattach this properly.

In a further embodiment, the flip cover comprises features that ensure that the flip cover is not dislocated unless this cover is purposely opened or removed. A dislocated part of a closure system, such as the flip cover, could be contaminated, and if such non-sterile body comes into a sterile area this could seriously disrupt the process taking place in this area. In this embodiment, the flip cover is provided with two-stage legs. Accordingly, the legs extending downwardly from the circular disc comprise a second part. The first part is the bar while the second part is an extended leg comprising a longer elongated bar. Hence, the second part extends further and these two-stage legs ensure the flip cover is tightly secured to the cover aperture, and this feature prevents the flip cover becoming dislocated during opening and/or after opening. The extended legs secure the flip cover in place by compression of the second part of the legs between the underside of the cover aperture of the cap and the upper surface of the stopper. When the flip cover, comprising such two-stage legs, is positioned on top of the cover aperture of the cap, which overlies the stopper, the two-stage leg preferably extends downwardly from the circular disc and ends at the periphery of the upper surface of the stopper, and towards the internal perimeter of the cap. In this embodiment, at least one of the legs extending from the circular disc is a two-stage leg. When removing the flip cover from the cap, the first part of the legs detach from the cover aperture of the cap and function as a tamper-evident feature. With the two-stage legs, the flip cover is still held by the second part of the legs, still held in a squeeze between the cover aperture of the cap and the stopper. Further removal stretches and pulls the second part of the leg out, restricted only by friction. When the flip cover is lifted well away from the cover aperture of the cap it is easy to grip hold of and securely remove, or alternatively leave it hinged, by one or two of the two-stage legs. With these two-stage legs it is prevented that the flip cover is dislocated such as falling off during removal. In a preferred embodiment, the flip cover includes such two-stage legs providing both a tamper evident function and a feature that prevents the flip cover from becoming dislocated during and/or after opening. In addition to these functions on the flip cover, the cap has, in a particularly preferred embodiment, a tamper-evidencing element detachably attached to the lower end of the skirt of the cap.

The flip cover may in one embodiment include an opening element, making it easier to flip open the flip cover. One example of such opening element is a pier handle, such as a rounded handle extending from the periphery of the generally circular disc of the flip cover. Preferably, such opening element is placed straight across from the at least one two-stage leg, directing where the flip cover opens.

In a further embodiment, the cap is provided with a member which engages with the stopper when the package is closed to protect a defined region of the stopper from contamination. The member is advantageously an annular member which extends downwardly from the cover aperture of the cap, between the inner and outer perimetrical rim, and engages with the upper surface of the stopper. The annular member then provides a physical barrier to contaminants and helps keep the defined region sterile. The integrity of a seal created by the member is preferably achieved by the member resiliently deforming the part of the stopper against which it engages. In the embodiment wherein the flip cover comprises two-stage legs, the annular member will engage with the extended legs, such that the legs are slightly bended over the annular member forcing the legs tightly between the stopper and the underside of the cover aperture, increasing the force needed to pull the legs out.

The package of the invention may be filled with any liquids, but is preferably for use with a sterile liquid, such as a pharmaceutical composition. Most preferably, the package is for use with a contrast media. In one embodiment, the bottle of the package is filled with such sterile liquid.

Preferred embodiments of the invention will now be described by way of example only and with reference to the accompanying drawings, in which FIG. 1 shows the closure system 10 of a package of the invention. The main elements of the closure system 10 are a stopper 40, a cap 50 and a flip cover 60. The stopper is preferably formed from a rubber, but may be formed from other synthetic polymer materials or synthetic rubber (e.g. chlorobutyl rubber) or natural rubber. A part of the bottle 20 is shown with its neck portion 26 having external screw threads 28 formed thereon.

The stopper 40 has a generally cylindrical body 42, and the radius of the body is slightly greater than the radius of the inner surface of the neck of the bottle. This allows the body 42 of the stopper 40 to be an interference fit in the neck 26 of the bottle. The stopper thus seals the bottle. The lower end of the body 42 has a chamfer 44, to aid insertion of the body 42 into the neck 26 of the bottle 20. The stopper has an upper surface 41, with a periphery 43. At the upper end of the body 42 is a flange 46. The flange 46 rests on the top of the neck of the bottle 20 when the stopper 40 is fully inserted there into. In this embodiment, the lower surface of the stopper 40 is formed with a hollow 48 therein.

The cap 50 is attached to the upper part of the neck 26 of the bottle 20. The cap has a cover aperture 52 which overlies the stopper 40, and an annular skirt 55 extending downwardly from the edge of the cover. The cover aperture comprises a perimetric inner rim 56 defining the circumference edge of the orifice 54, i.e. the passageway, of the cover aperture 52. An outwardly facing cylindrical wall 58 extends about the perimetric outer rim 59 of the cover aperture 52, projecting downwardly from the rim. In this example, the underside of the cover aperture 52 further includes an annular member 53 extending downwardly from it. The lower end of the annular member engages with the upper surface of the stopper 40 and helps to ensure the integrity of the closure system 10. In addition, the annular member 53 surrounds a central region of the upper surface of the stopper, and helps to prevent contamination of it. The skirt 55 has an internal screw thread 57 formed on its inner surface, which engages with the external screw thread 28 formed on the neck 26 of the bottle 20 to retain the closure in place.

The flip cover 60 includes a planar circular disc 62 and a periphery wall 64 extending downwardly around the circular disc, whose circumference matches that of the circular disc. The circular disc 62 overlays the cover aperture 52, including the orifice 54, of the cap 50 such that the circular disc 62 engages with the cover aperture, which overlies the stopper 40. The periphery wall 64 of the flip cover is engaged with the cylindrical wall 58 of the cap 50.

Extending downwardly from the underside of the circular disc 62 of the flip cover 60 a set of legs 70 is located. The two-stage legs are, before assembly of the cap, extending outwardly from the circular disc and are annularly arranged. The legs are positioned annularly adjacent to the perimetric inner rim 56 of the cover aperture 52 of the cap 50. In this embodiment, a leg includes a first part 74 extending downwardly from the circular disc, and a second part 76 which is an extension of the leg ending at the periphery of the upper surface 43 of the stopper, and towards the internal perimeter 51 of the cap. The two-stage legs 70 extending from the underside of circular disc 62 of the flip cover towards the internal perimeter 51 of the cap are forced tightly between the upper surface 41 of the stopper 40 and the underside of the cover aperture, bended over the annular member 53 of the cover aperture of the cap.

Figure 2:
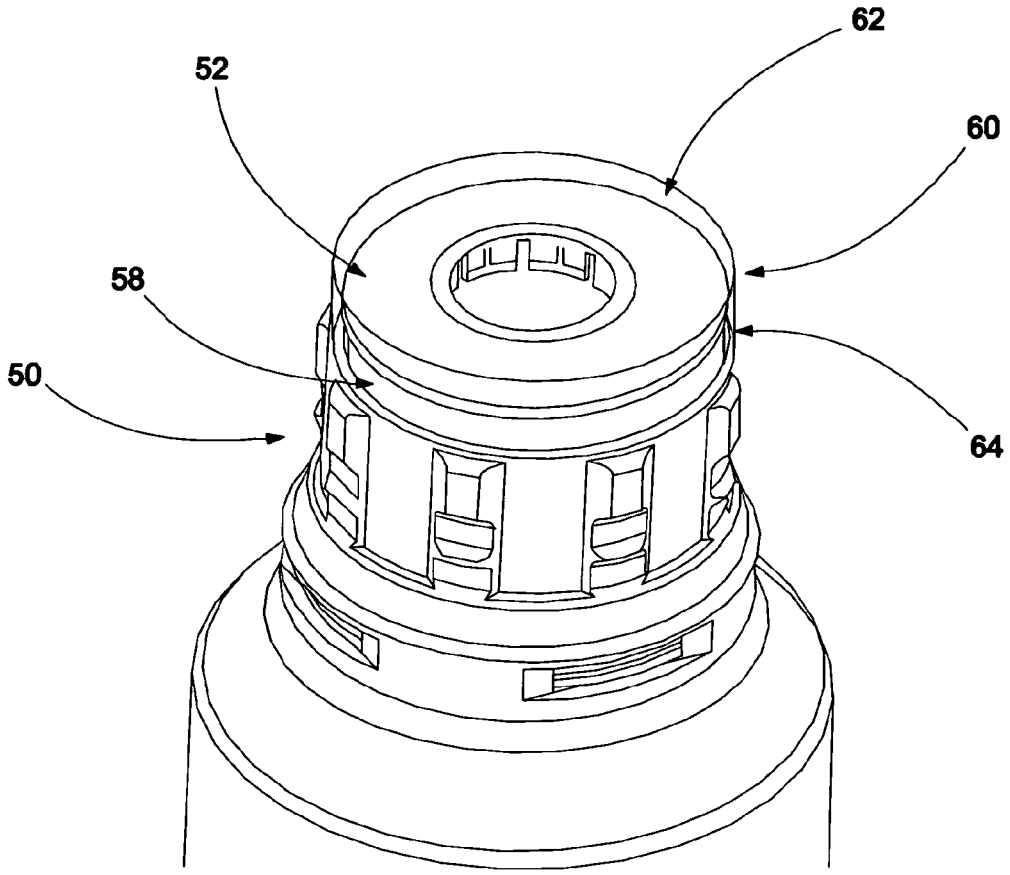

FIG. 2 shows the cap 50 and the flip cover 60 of the closure system 10 of the invention seen from the outside. The flip cover comprises a planar circular disc 62. The flip cover overlies the cover aperture 52 of the cap such that the disc engages with the cover aperture. The flip cover further comprises a periphery wall 64 extending about the periphery of the disc 62, engaging with the outwardly facing cylindrical wall 58 of the cap.

Figure 3:
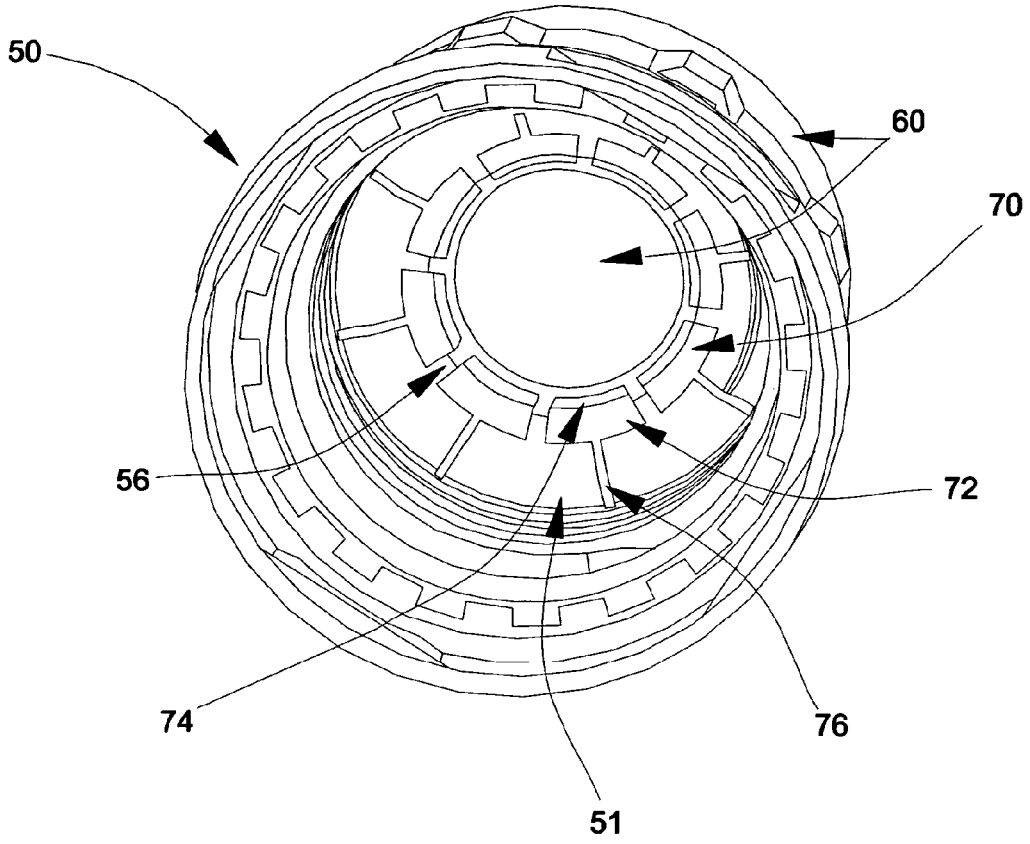

FIG. 3 shows the cap 50 and the flip cover 60 of the closure system 10 of the invention seen from the inside to show how the legs 70 are positioned. A leg includes a first part 74 which is a bar extending downwardly from the circular disc, and a second part 76, comprising an elongate rod which extends towards the internal perimeter 51 of the cap. At the end of the first part 74 of a leg 70 a bended portion 72 is included which hinges to the perimetric inner rim 56 of the cover aperture 52, while the second part 76 extends to the internal perimeter 51 of the cap.

Figure 4:
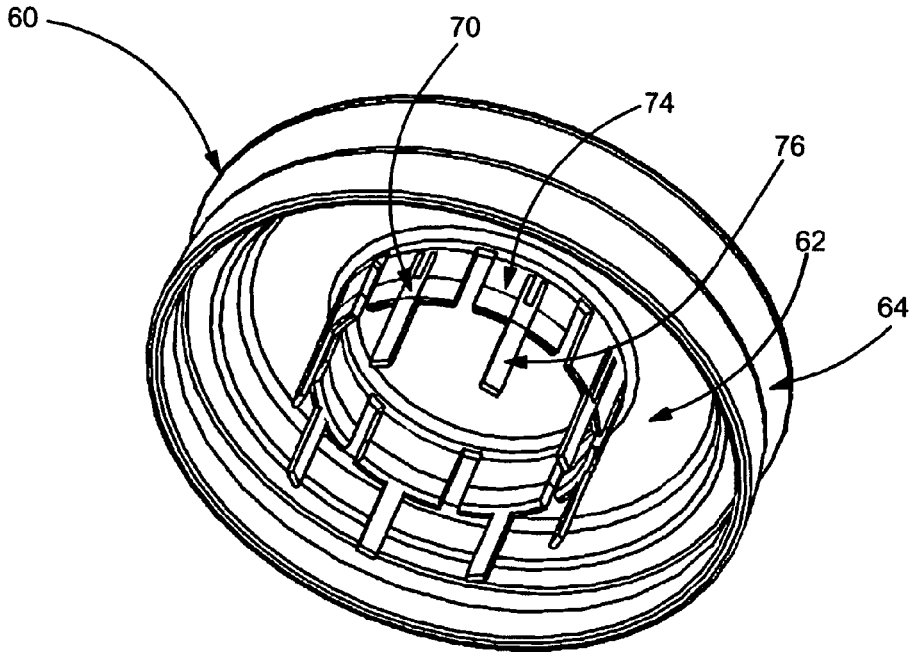
FIG. 4 depicts the flip cover 60.

FIG. 4 shows the flip cover 60, showing the two-stage legs 70 when the flip cover is not mounted on the cap. In this example the flip cover 60 includes 8 legs annularly positioned, and regularly spaced, extending from the circular disc 62. The legs include a first part 74 and a second part 76. The flip cover further comprises a periphery wall 64 extending about the periphery of the disc 62.

Figure 5:
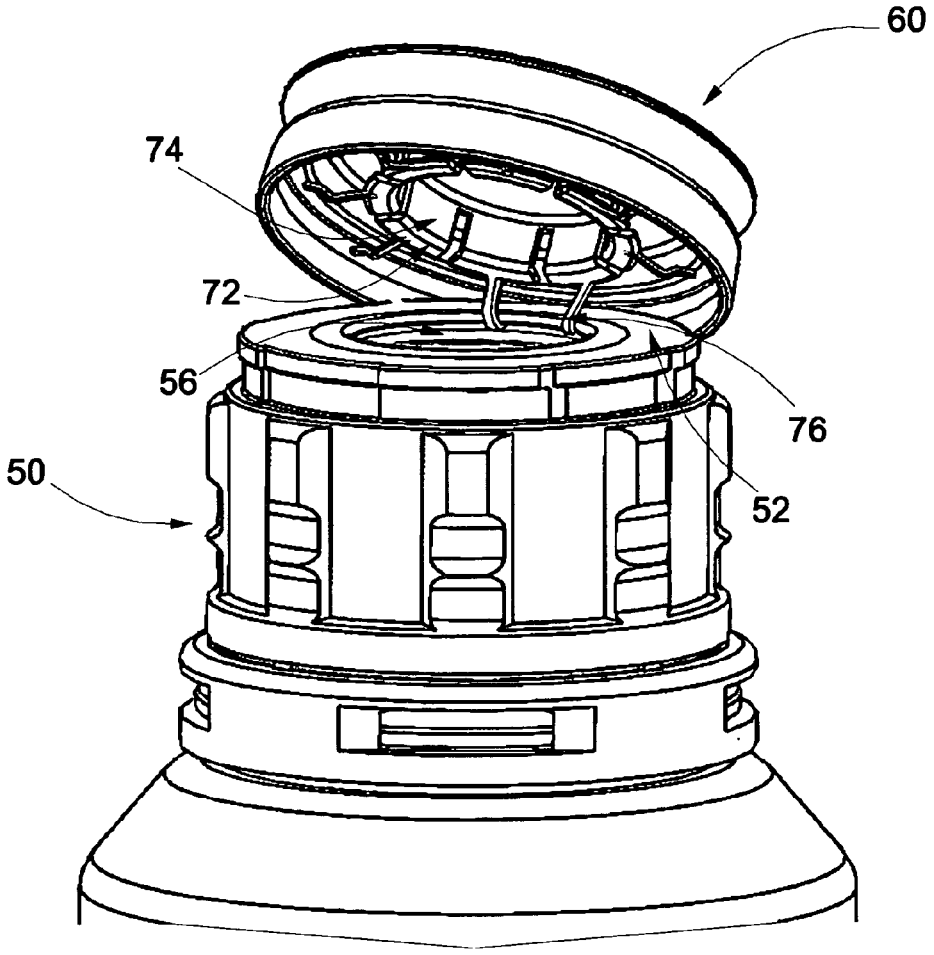
FIG. 5 depicts the cap 50 and the flip cover 60, with the flip cover in a half removed position.

FIG. 5 shows the cap 50 and the flip cover 60 of the closure system 10 of the invention seen from the outside when the flip cover has been opened, but is still attached. At the end of the first part 74 of a leg 70 a bended portion 72 is included which is now loosen from the perimetric inner rim 56 of the cover aperture 52 of the cap 50, while the second parts 76 of two legs still hinge under the perimetric inner rim 56 of the cover aperture 52 and towards the internal perimeter 51 of the cap.

What is claimed is:

1. A package comprising a) a container with a mouth, b) a stopper removably inserted into said mouth, c) a cap overlying said stopper wherein said cap comprises a cover aperture defining a centrally-located passageway there through, d) a removable flip cover which can be removed to gain access to the stopper, wherein said removable flip cover comprises a circular disc overlaying the cover aperture of the cap, wherein the flip cover further comprises a plurality of legs, at least one of the plurality of legs comprising a first part extending downwardly from the circular disc, and a second part extending from the first part, wherein the second part of the at least one of the plurality of legs extends between an underside of the cover aperture and an upper surface of the stopper, and wherein the first part of the at least one of the plurality of legs is a bar and the second part of the at least one of the plurality of legs comprises a longer elongated bar.

2. The package as claimed in claim 1 wherein the cover aperture comprises an inner and an outer perimetrical rim, wherein the inner rim defines the circumference edge of the passageway of the cover aperture.

3. The package as claimed in claim 1, wherein the passageway of the cover aperture aligns in overlying registry with the upper surface of the stopper.

4. The package as claimed in claim 1 wherein at least one of the plurality of legs secures the flip cover in place by compression of the second part of the leg between the underside of the cover aperture of the cap and the upper surface of the stopper.

5. The package as claimed in claim 2, wherein the cap is provided with an annular member which extends downwardly from the cover aperture of the cap, between the inner and outer perimetrical rim, and engages with the upper surface of the stopper when the package is closed to protect a defined region of the stopper from contamination.

6. The package as claimed in claim 1, wherein the flip cover comprising the plurality of legs provides a tamper evident function, and further comprises a tamper-evidencing element detachably attached to the lower end of the cap.

7. The package as claimed in claim 1, wherein the container is filled with a sterile liquid.

8. The package as claimed in claim 1, wherein the second part of the at least one of the plurality of legs extends between the underside of the cover aperture and the upper surface of the stopper and extends towards an internal perimeter of the cap.

9. A package comprising:

a) a container with a mouth, b) a stopper removably inserted into said mouth, c) a cap overlying the stopper, the cap comprising a cover aperture, and d) a flip cover which can be moved from a first position to a second position to gain access to the stopper, wherein the flip cover comprises a circular disc overlaying the cover aperture of the cap and a plurality of legs, at least one of the plurality of legs comprising a first part extending downwardly from the circular disc and a second part extending from the first part, wherein the plurality of legs are in:

the first position when the flip cover is positioned on top of the cover aperture of the cap, wherein the first part of the at least one of the plurality of legs remains extending downwardly from the circular disc and the second part of the at least one of the plurality of legs extends towards an internal perimeter of the cap, and the second position when the flip cover provides access to the stopper, wherein the first part of the at least one of the plurality of legs detaches from the cover aperture and the second part of the at least one of the plurality of legs remains between the cover aperture of the cap and the stopper after the flip cover is lifted away to provide access to the stopper, and wherein the first part of the at least one of the plurality of legs is a bar and the second part of the at least one of the plurality of legs comprises a longer elongated bar.

10. A package comprising:

a) a container with a mouth, b) a stopper removably inserted into the mouth, c) a cap overlying the stopper, the cap comprising a cover aperture, d) a removable flip cover which can be removed to gain access to the stopper, wherein the removable flip cover comprises a circular disc overlaying the cover aperture of the cap and a plurality of legs, at least one of the plurality of legs comprising a first part extending downwardly from the circular disc and a second part extending from the first part, wherein the second part of the at least one of the plurality of legs extends between an underside of the cover aperture and an upper surface of the stopper and extends to an internal perimeter of the cap, and wherein the first part of the at least one of the plurality of legs is a bar and the second part of the at least one of the plurality of legs comprises a longer elongated bar.

* * * * *